United States Patent [19]

Bonfiglioli et al.

[11] Patent Number: 4,986,242

[45] Date of Patent: Jan. 22, 1991

[54] ELECTRONIC FUEL INJECTION SYSTEM FOR AN INTERNAL COMBUSTION ENGINE

[75] Inventors: Silverio Bonfiglioli, Zola Predosa; Massimo Fato, Modena, both of Italy

[73] Assignee: Weber S.r.l., Turin, Italy

[21] Appl. No.: 307,781

[22] Filed: Feb. 7, 1989

[51] Int. Cl.[5] ..... F02D 41/14; F02D 41/04; F02D 41/22

[52] U.S. Cl. ..... 123/479; 123/480; 123/478; 123/488; 123/489

[58] Field of Search ..... 123/478, 479, 480, 488, 123/489, 491, 492, 493, 494

[56] References Cited

U.S. PATENT DOCUMENTS

| | | | |
|---|---|---|---|
| 3,750,632 | 8/1973 | Zechnall | 123/488 X |
| 4,155,332 | 5/1979 | Yaegashi et al. | 123/480 |
| 4,184,458 | 1/1980 | Aoki et al. | 123/480 X |
| 4,543,937 | 10/1985 | Amano et al. | 123/491 |
| 4,561,399 | 12/1985 | Kobayashi et al. | 123/480 X |
| 4,565,174 | 1/1986 | Suzuki et al. | 123/480 X |
| 4,572,143 | 2/1986 | Umesaki et al. | 123/479 |
| 4,662,333 | 5/1987 | Martel | 123/339 |
| 4,753,206 | 6/1988 | Inoue et al. | 123/480 |
| 4,766,869 | 8/1988 | de Concini et al. | 123/478 |
| 4,781,267 | 11/1988 | Waineo et al. | 180/268 |

*Primary Examiner*—Tony M. Argenbright
*Attorney, Agent, or Firm*—Gifford, Groh, Sprinkle, Patmore and Anderson

[57] ABSTRACT

An electronic fuel injection system for an internal combustion engine comprising an electronic control system having a central processing unit for detecting engine speed, throttle setting regulating air supply to the engine, exhaust gas concentrations, and for controlling fuel injection. The central processing unit also calculates an open basic injection time, corrected by sensors for engine cooling water and air supply temperature and a closed-loop injection time using an exhaust gas sensor.

10 Claims, 3 Drawing Sheets

ELECTRONIC FUEL INJECTION SYSTEM FOR AN INTERNAL COMBUSTION ENGINE

BACKGROUND OF THE INVENTION

The present invention relates to an electronic fuel injection system for an internal combustion engine, said system comprising an electronic control system wherein a central processing unit receives signals from major operating parameter sensor means designed to detect engine speed, the setting of the throttle regulating air supply to the engine, and the concentration of exhaust gas components; and wherein said electronic control unit provides for controlling fuel injection, preferably via a single-point injection unit. In particular, as a function of engine speed and the throttle setting, the central processing unit calculates (in open-loop manner) a basic injection time, which, depending on various operating conditions, is corrected via parameters supplied by additional sensor means for detecting at least the engine cooling water and air supply temperatures, as well as by a signal from an exhaust gas sensor (for closed-loop calculation of controlled injection time).

Known injection systems of the aforementioned type differ substantially in terms of the design and operating program of the electronic control system, as a function of the performance demanded of the injection system itself.

SUMMARY OF THE INVENTION

The aim of the present invention is to provide an electronic injection system of the aforementioned type, which is relatively cheap to produce, while at the same time ensuring reliable performance, comparable to that of more sophisticated systems, by virtue of providing for a relatively small discrepancy between actual and theoretical injection time.

With this aim in view, according to the present invention, there is provided an electronic fuel injection system for an internal combustion engine, said system comprising an electronic control system having a central processing unit for receiving signals from engine speed detecting means; from means detecting the setting of the throttle regulating air supply to said engine; from exhaust gas detecting means; from engine cooling water temperature detecting means; and from engine air supply temperature detecting means; characterized by the fact that said signals from said engine cooling water temperature detecting means, and from said engine air supply temperature detecting means, are supplied alternatively to an input of said central processing unit via means for selecting said input signals; said selecting means being controlled by said central processing unit.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
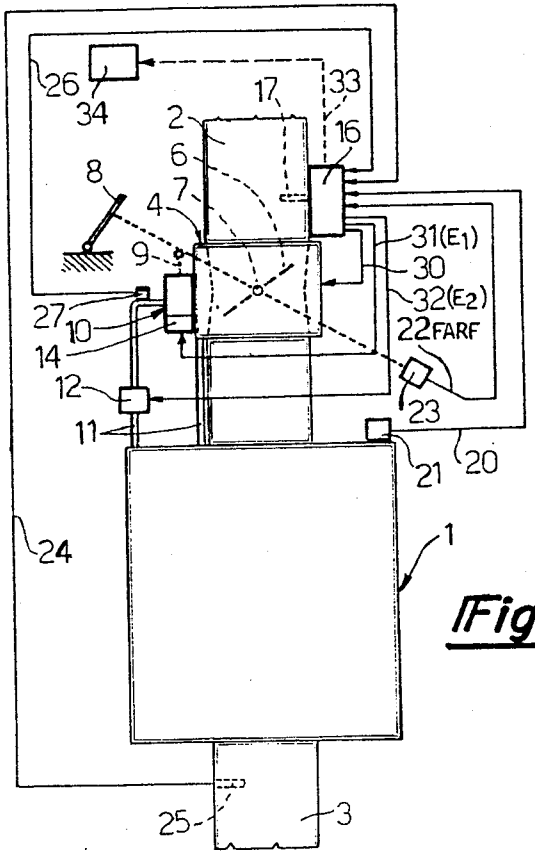
FIG. 1 shows a schematic view of the electronic injection system according to the present invention, and applied to an internal combustion engine.

Number 1 in FIG. 1 indicates, schematically, a motor vehicle internal combustion engine having an intake pipe 2 and an exhaust pipe 3. Said intake pipe 2 is fitted inside, in substantially known manner by means of connecting flanges, with an electronic injection unit 4 conveniently consisting of a single-point injector. At said unit 4, said intake pipe 2 is also fitted with a main throttle 6 having a rotary shaft 7 and the setting of which is controlled mechanically by a pedal-operated accelerator 8. The minimum rotation position of said shaft 7 is controlled mechanically by piston 9 of a heat-sensitive element 10 conveniently containing a wax mixture and, for example, of the type described in Italian Patent Application No. 67105-A/87 filed on 17 Feb., 1987 by the present Applicant, and the content of which is included herein purely by way of reference as required.

Said heat-sensitive element 10, which is supported on injection unit 4, is thermally connected directly to an electric heating element 14, and is arranged in thermal contact with a circuit 11 for recirculating the engine cooling water and featureing a solenoid valve 12.

Number 16 indicates an electronic control system mounted on intake pipe 2, for controlling the injection system according to the present invention. Said control system 16 is fitted directly with a substantially known type of air supply temperature sensor 17 for detecting the temperature of the air supply to engine 1, and therefore located in such a manner as to be swept by the air flow along pipe 2.

Control system 16 receives:

a first input signal 20 from the primary circuit of ignition coil 21, for detecting the speed of engine 1;

a second input signal 22 (FARF) indicating the setting of throttle 6 and supplied by a conveniently single-track, substantially linear potentiometer 23 connected in known manner to shaft 7;

a third input signal 24 supplied by a substantially known exhaust pipe sensor 25 in exhaust pipe 3, for detecting the concentration of at least one exhaust gas component, and possibly comprising a CO detector in exhaust pipe 3 or even a trivalent catalyst;

a fourth input signal 26 supplied by a cooling water sensor 27 connected to circuit 11, for detecting the temperature of the cooling water of engine 1.

Control system 16, in turn, supplies:

a first control signal 30 for controlling the single-point injector of unit 4;

a second control signal 33 for controlling an optical and/or acoustic alarm device 34;

a third control signal 31 and fourth control signal 32 for respectively controlling electric heating element 14 and solenoid valve 12.

Figure 2:
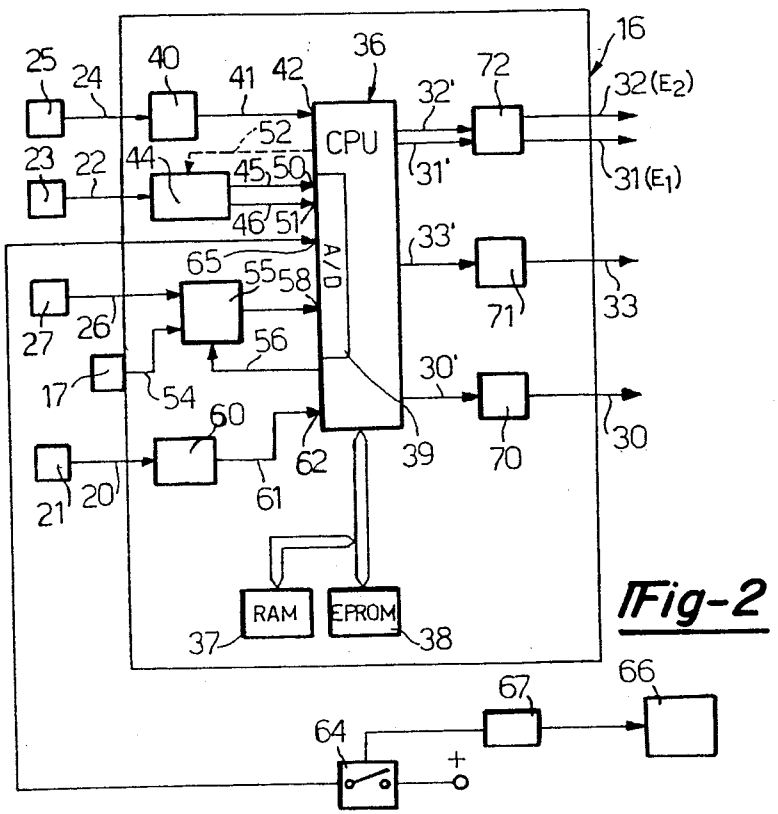
FIG. 2 shows a block diagram of the electronic control system on the FIG. 1 system.

FIG. 2 shows a more detailed view of control system 16, which comprises a microprocessor-based central processing unit (CPU) 36 connected to RAM and EPROM memory blocks 37 and 38, and fitted directly with an analogue-digital converter block 39 with a relatively small number of inputs (in this case, four).

Figure 4A:
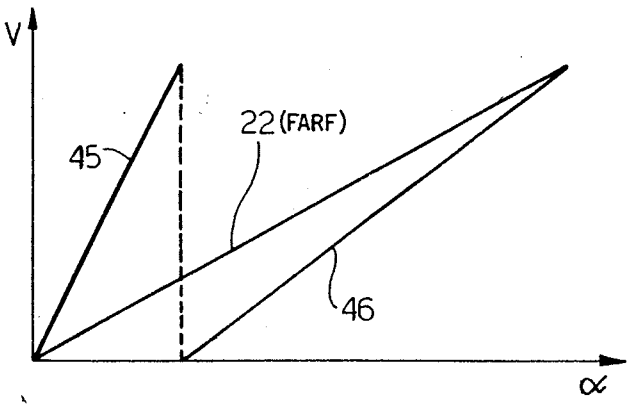
FIGS. 4*a* and 4*b* show a more detailed block diagram of a component in FIG. 2, and the variation in a parameter detected by the FIG. 4*a* block.
Figure 4B:
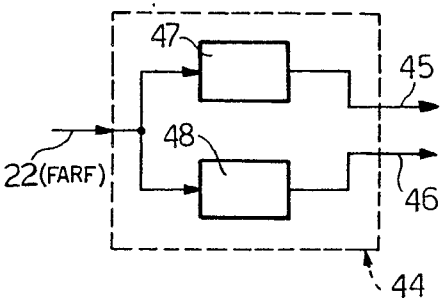

Under normal operating conditions of engine 1 and sensor 25, signal 24 supplied by sensor 25 flickers above and below an intermediate range of values defining a substantially correct stoichiometric ratio of the air/fuel mixture being supplied. According to one characteristic of the present invention, said signal 24 is supplied directly to first block 40 of control system 16, which block 40 comprises an amplifying circuit (usually for amplifying signal 24 from 0/1 V to approximately 3 V) followed by a threshold comparator circuit (e.g. a Schmitt trigger). Block 40 therefore supplies a first digital output signal 41 indicating the concentration of the exhaust gases (rich or lean mixture), and which is sent directly to first digital input 42 of central processing unit 36. Signal 22 (FARF) supplied by potentiometer 23 is a linear signal, i.e. the voltage of which is directly proportional to the setting angle ($\alpha$) of throttle 6, as shown in FIG. 4*b*. For enabling various throttle 6 setting ranges to be determined to varying degrees of accuracy, and so reducing (e.g. to 2%) the error percentage of control signal 30 supplied to injection unit 4, said signal 22 is supplied to second block 44 of control system 16 (FIG. 2), which supplies second and third output signals 45 and 46 of differing slope, as shown in FIG. 4*b*. Said block 44 (FIG. 4*a*) conveniently comprises first and second amplifying blocks 47 and 48, which provide for differing degrees of amplification of input signal 22, and respectively supply outut signals 45 and 46, which are supplied respectively to first and second analogue inputs 50 and 51 of analogue-digital converter block 39. Central processing unit 36 may supply block 44 with a CPU digital signal 52 for controlling selection of the output signals from block 44, which may present more than two amplifying blocks having different amplifying coefficients, for producing more than two output signals of different slopes and relative to various throttle 6 setting ranges. Central processing unit 36 therefore determines the throttle 6 angle ($\alpha$) as a function of the value of signals 45 and 46. Said block 44 is conveniently of the type described in Italian Patent Application entitles "System for converting a signal from a linear transducer, for enabling parameter aquisition to varying degrees of accuracy" filed on the same date by the present Applicant, and the content of which is included herein purely by way of reference as required.

With reference to FIG. 2, fourth input signal 26 and air supply temperature signal 54, supplied respectively by sensors 27 and 17 for detecting the cooling water and air supply temperatures of engine 1, are sent to respective inputs of a selecting block 55 of control system 16. Block 55 is controlled by a digital signal 56 supplied by processing unit 36, for selecting which signal to supply to the output of third block 55 connected to third analogue input 58 of analogue-digital converter block 39.

Figure 3A:
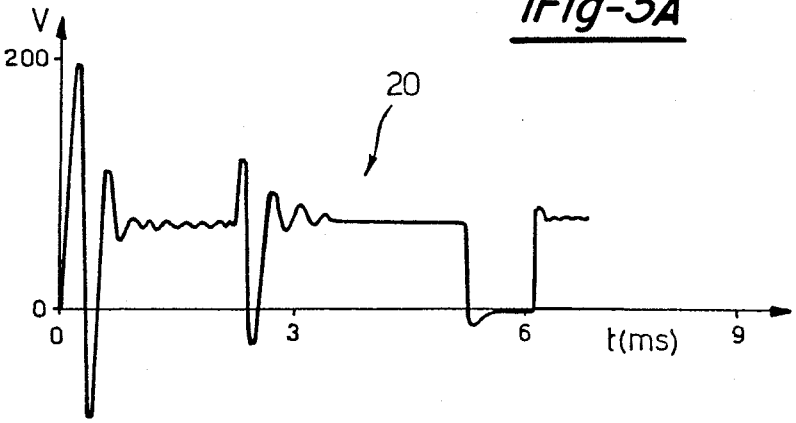
FIGS. 3*a* and 3*b* show graphs of signals on the FIG. 1 system.
Figure 3B:
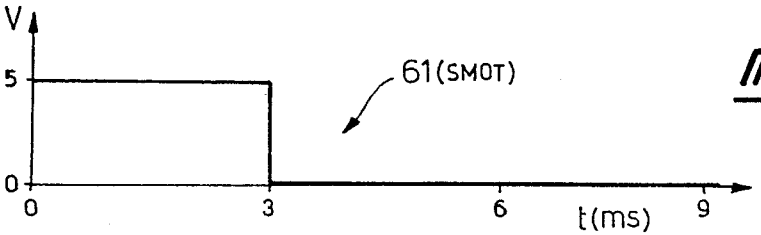

The speed of engine 1 is indicated by first input signal 20 on the primary circuit of ignition coil 21. As shown by way of example in FIG. 3*a*, this presents an initial oscillation of approximately 200 V, and a cycle, depending on the speed of engine 1, ranging for example between 5 milliseconds (maximum engine speed) and 45 milliseconds (idling speed). Said signal 20 is supplied to fourth block 60 of control system 16, which comprises, for example, a flip flop supplying a square-wave output signal 61 (SMOT) of approximately 3 milliseconds (FIG. 3*b*), and the frequency of which is therefore a function of the speed of engine 1. Said signal 61 is supplied to second digital input 62 of central processing unit 36, by which it is processed in the normal manner, e.g. by means of counters, to give the required control parameter.

According to a further characteristic of the present invention, the positive system supply voltage from the vehicle battery is supplied, via a switch block 64 controlled by the vehicle ignition key, to fourth analogue input 65 of analogue-digital converter block 39. Said switch block 64 also supplies an electric pump 66, for supplying fuel to injection unit 4, via an inertial type relay block 67, i.e. designed to open in the event of the vehicle being arrested sharply, as in the case of collision.

Central processing unit 36 then supplies first, second, third, and fourth pre-pilot block signals 30', 33', 31', and 32' which, via respective first, second, and third pilot blocks 70, 71, and 72 determine first, second, third, and fourth control signals 30, 33, 31 and 32.

Figures 5A, 5B:
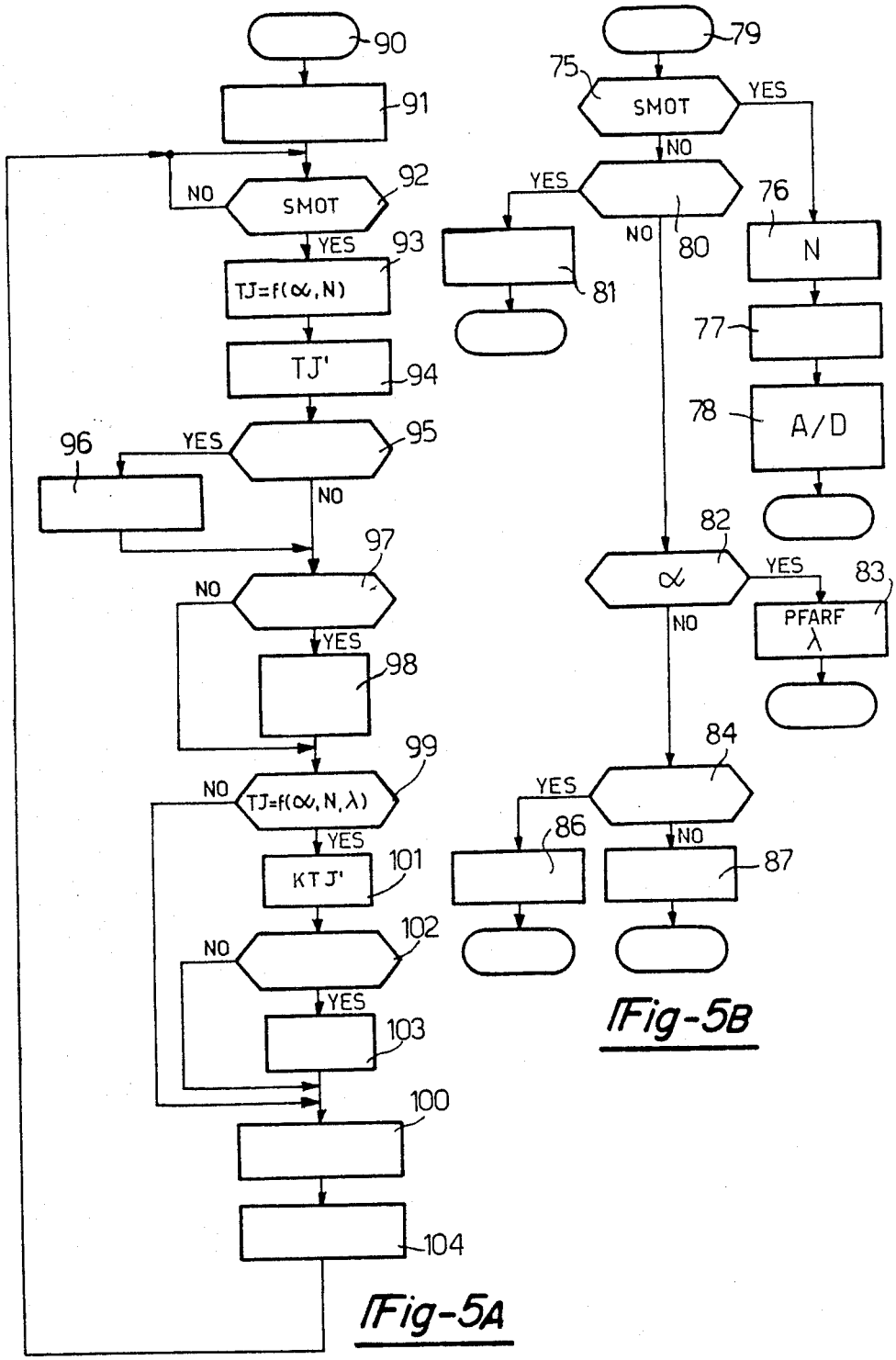
FIGS. 5*a* and 5*b* show operating block diagrams of the central processing unit of the FIG. 2 control system.

FIG. 5*b* shows the signal receiving and sending program of central processing unit 36, which is repeated periodically at convenient intervals of a few milliseconds. An first "interrupt" starting block 74 goes to block A75, which determines whether engine speed signal 61 (SMOT) is present. In the event of a positive response, block 75 goes to block 76, which, in known manner and on the basis of previously received signals 61, calculates parameter N indicating the speed of engine 1. Block 76 then goes on to block 77, which enables the single-point injector of injection unit 4, in time with engine 1, and with a predetermined lag in relation to top dead center, determined for example in conventional manner via the vehicle ignition system. Block 77 goes on to block 78, which comntrols acquisition and processing of the signals supplied to inputs 58 and 65 of analogue-digital converter block 39, which marks the end of the subroutine. At each signal 61 (SMOT), i.e. at each phase of engine 1, blocks 76, 77 and 78 provide for calculating engine speed parameter N, enabling synchronous injection, alternately picking up the signals from sensors 27 and 17, as well as for picking up the battery voltage signal.

In the event of a negative response in block 75, i.e. no signal 61 (SMOT), block 75 goes on to block E80, which determines whether the conditions (as provided for by the main program of processing unit 36) exist for controlling operation of the single-point injector of unit 4. In the event of a positive response, block 80 goes on to block 81, which determines signal 30' for controlling on-off time of the injector either synchronously or asynchronously, as determined by the program, which thus marks the end of the subroutine.

In the event of a negative response in block 80, this goes on to block 82, which determines whether or not the throttle 6 setting signal is to be sampled (sampling is repeated at a predetermined rate, e.g. every 10 milliseconds). In the event of a positive response, block 82 goes on the block 83, which controls aquisition and processing of signals 45 and 46 to give the PFARF parameter (and its derivative) indicating the setting ($\alpha$) of throttle 6. Block 83 also controls acquisition of first digital output signal 41 supplied by sensor 25, which thus marks the end of the subroutine. In the event of a negative response in block 82, this goes on to block 84, which determines whether the conditions exist for controlling heat-sensitive element 10. In the event of a positive response, block 84 goes on to block 86, which determines signals 31' and 32' for controlling electric heating element 14 and solenoid valve 12, which thus marks the end of the subroutine.

In the event of a negative response in block 84, this goes on to block 87, which enables signal 33' for controlling acousticalarm device 34, if a breakdown has been detected by the main program, which thus marks the end of the subroutine.

The main program of central processing unit 36 is shown in FIG. 5a second starting block 90 goes to block 91, which provides for data and parameter initialization in the various registers and memories. Block 91 then goes on to block 92, which determines whether a signal 61 (SMOT) has been supplied to central processing unit 36. In the event of a negative response, block 92 goes back to its input, whereas, in the event of a positive response, it goes on to block 93, which calculates, in known manner, a basic injection time TJ, as a function of the PFARF and N parameters (Throttle 6 setting and engine speed) obtained via blocks 83 and 76. Said TJ value is thus determined in open-loop manner.

Block 93 goes on to block 94, which provides, in substantially known manner, for correcting basic injection time TJ, to give a corrected injection time TJ'. Said correction is performed subject to the signals supplied by ignition coil 21, air supply temperature sensor 17, cooling water sensor 27, potentiometer 23, exhaust pipe sensor 25, and fourth analogue input 65, taken both singly and in conjunction with one another, and subject, for example, to variations in operating parameters, such as the temperature of the cooling water or air supplyu to engine 1 or supply voltage (which affects delivery by electric pump 66), or to special operating conditions, such as starting of engine 1 or transient engine speeds caused by a sharp change in the setting of throttle 6.

Block 94 goes on to block 95, which determines, in substantially known manner, the existence of "cut-off" conditions, i.e. release of accelerator pedal 8 with engine 1 running above a predetermined speed threshold. In the event of a positive response, block 95 goes on to block 96, which provides for disabling the single-point injector of unit 4 and then goes on to block 97. In the event of a negative response in block 95, this goes directly to block 97.

Block 97 determines, in substantially known manner as described in said Patent Application No. 67105-A/87, whether the conditions exist for controlling engine 1 at idling speed via heat-sensitive element 10. In the event of a positive response, block 97 goes on to block 98, which calculates the values of third and fourth pre-pilot block signals 31' and 32' and then goes on to block 99. In the event of a negative response in block 97, this goes directly to block 99.

Block 99 determines, in substantially known manner, whether the conditions exist for controlling injection time also as a function of the exhaust gas concentration detected by exhaust pipe sensor 25, so as to provide for closed-loop control (such control is not adopted, for example, when warming up engine 1, or at maximum engine power, etc.). In the event of a negative response, block 99 goes directly to block 100, and, in the event of a positive response, to block 101, which, in substantially known manner, provides for correcting injection time to give a corrected injection time KTJ'. Block 101 then goes on to block 102, which determines, in known manner, the existence of system self-adaptation conditions, due, for example, to variations in input parameters or component values. In the event of a negative response, block 102 goes on to block 100, and, in the event of a positive response, to block 103, which provides for calculating the factors by which to correct the set injection plan (N, $\alpha$ plan).

Block 103 goes on to block 100, which, in substantially known manner, checks operation of the various input and output circuits on control system 16. In the event of failure, block 100 provides for emitting signal 33', as well as for controlling the single-point injector of unit 4 in such a manner as to guarantee minimum operation of engine 1.

Block 100 goes on to block 104 which, depending on the corrected injection time of the single-point injector of unit 4, provides for synchronous or asynchronous injection in relaton to the phase of engine 1, abnd also prepared injection unit 4 for injection. Block 104 then goes back to block 92.

The advantages of the electronic injection system according to the present invention will be clear from the foregoing description. Firstly, the relatively straightforward circuitry of control system 16, combined with a few improvements to the design of the operating blocks of central processing unit 36, provides for a reliable, relatively low-cost system, with an actual injection time error of no more than a few percent. In particular, it provides for limiting the number of analogue input signals to processing unit 36, so that the analogue-digital converter may even form part of unit 36 itself. In fact, by virtue of varying relatively slowly, the engine cooling water and air intake temperature signals are sampled alternately. Moreover, by means of a straightforward circuit, the signal from exhaust gas sensor 25 is supplied directly to a digital input of central processing unit 36. Engine air supply temperature sensor 17 is therefore built into control system 16, by virtue of this being mounted in the vicinity of the intake manifold. For determining engine speed, the relative signal is picked up directly from the primary circuit of the ignition coil, thus enabling the signal, by means of a straightforward circuit, to be sent directly to a digital input on central processing unit 36. Again by means of relatively straightforward circuitry, a simple linear potentiometer may be employed for determining the setting of throttle 6, and so obtaining signals of differing slope for different setting ranges, depending on the resolving capacity required. Finally, operation of the electric fuel supply pump is controlled by means of a straightforward inertial relay.

To those skilled in the art it will be clear that changes may be made to the system as described and illustrated herein without, however, departing from the scope of the present invention.

What is claimed:

1. An electronic fuel injection system for an internal combustion engine, comprising:

an intake pipe fitted with a single point electronic injection unit;

a main throttle fitted to said intake pipe at said unit, said throttle having a rotary shaft set mechanically by an accelerator where the minimum rotation of said shaft is controlled mechanically by a piston from a heat-sensitive element;

an electronic control system mounted onto said intake pipe, said control system comprising a central processing unit (CPU) and an analogue-digital converter block, said control system further connected to RAM and EPROM memory blocks; said CPU controlling operation of said single-point electronic injection unit;

a first input signal from an ignition coil received by said control system;

a second input signal from a single track, substantially linear potentiometer received by said control system;

a third input signal from an exhaust pipe sensor received by said control system, said exhaust pipe sensor capable of detecting the concentration of at least one exhaust gas component;

a fourth input signal from a cooling water sensor and an air supply temperature signal from an air supply temperature sensor received by said control system, said air supply temperature sensor being supported directly on said electronic control system.

2. The system of claim 1 comprising in addition an analogue input from a block controlled by a digital signal from said CPU, said analogue input alternatively receiving said signal from said cooling water sensor and said signal from said air supply temperature sensor, said analogue input further transmitting said signals received to said analogue-digital converter block.

3. The system of claim 1, wherein said signal from said exhaust pipe sensor is supplied to a first digital input on said CPU, said signal from said exhaust pipe sensor being further subject to amplifying and level comparing means from a first block.

4. The system of claim 1, comprising in addition a switch block supplying a positive system supply voltage of an analogue input of said analogue-digital converter block, said switch block additionally supplying voltage to an electric pump for supplying fuel to said electronic injection unit, said pump supplied via an inertial type relay block, said relay block designed to open in the event of vehicle collision.

5. The system of claim 1, wherein said single-track, substantially linear potentiometer supplies first and second output signals of differing slope to said CPU via a second block comprising first and second amplifying blocks, said CPU further supplying said second block with a digital signal for controlling selection of said first or second output signal for different setting ranges of said main throttle.

6. The system of claim 1, wherein said first input signal from said ignition coil is received by a block comprising a flip-flop and reproduced as a square wave output signal, said output signal received as a second digital input by said CPU.

7. The system of claim 1, comprising in addition a second control signal from said electronic control system received by an alarm device.

8. The system of claim 1, comprising in addition said CPU having means for determining presence of said square wave output signal, enabling of said single point electronic injection unit, sampling of said main throttle signal, and receipt of said first and second output signals and said first digital output signal, respectively.

9. The system of claim 8, comprising means for controlling at least one of said single-point electronic injection unit, said heat-resistance element, and said alarm device.

10. The system of claim 1, wherein said CPU comprises in addition:

means for calculating in an open-loop manner a basic injection time (TJ) as a function of said first and second input signals for setting said main throttle regulating the air supply to said combustion engine;

means for correcting the basic injection time as a function of said first and second input signals;

means for determining specific operating conditions of said engine and for controlling operation of said single-point electronic injection unit, said heat sensitive element, and closed-loop calculation of basic injection time (TJ) as a function of said third input signal from said exhaust pipe sensor;

means for determining existence of system self-adaptation conditions;

means for calculating factors by which to correct the set injection plan;

means for checking operation of the input and output operating means of said electronic control system, and for providing for minimum operation of said engine in the event of failure; and means for selecting synchronous or asynchronous operation of said single point electronic injection unit in relation to the phase of said engine.

* * * * *